US006158192A

United States Patent [19]

Gardner

[11] Patent Number: 6,158,192

[45] Date of Patent: Dec. 12, 2000

[54] APPARATUS AND METHOD FOR APPLICATION OF FLEXIBLE SHEET STOCK

[76] Inventor: Gregory P. Gardner, 505 E. Exchange, Danvers, Ill. 61732

[21] Appl. No.: 08/883,395

[22] Filed: Jun. 26, 1997

Related U.S. Application Data

[62] Division of application No. 08/283,852, Aug. 1, 1994, Pat. No. 5,667,165.

[51] Int. Cl.[7] ..... E04D 15/06

[52] U.S. Cl. ..... 52/749.1; 52/746.1; 53/216; 156/71; 156/577; 156/579; 225/46; 242/596.1; 242/588.2

[58] Field of Search ..... 52/749.1, 746.1; 156/577, 579, 71; 242/588.2, 596.1, 596.4, 596.7, 596.8; 225/46, 47; 53/211, 216, 556, 587

[56] References Cited

U.S. PATENT DOCUMENTS

| | | | |
|---|---|---|---|
| D. 270,163 | 8/1983 | Shulman . | |
| 1,116,834 | 11/1914 | Nelson . | |
| 3,088,686 | 5/1963 | Curry . | |
| 3,570,731 | 3/1971 | Waltz . | |
| 3,617,424 | 11/1971 | Smith | 156/577 |
| 4,097,002 | 6/1978 | Krueger . | |
| 4,102,513 | 7/1978 | Guard . | |
| 4,166,589 | 9/1979 | Hoover et al. | 242/75.4 |
| 4,221,628 | 9/1980 | Rosenberg et al. | 156/577 |
| 4,248,031 | 2/1981 | Del Pozo, Jr. . | |
| 4,369,614 | 1/1983 | Tetzner . | |
| 4,417,941 | 11/1983 | Lin | 156/475 |
| 4,460,433 | 7/1984 | Boyd | 156/574 |
| 4,600,163 | 7/1986 | Hummel et al. . | |
| 4,690,345 | 9/1987 | Cotey . | |
| 4,741,490 | 5/1988 | Evans . | |
| 4,762,288 | 8/1988 | Eckels . | |
| 4,806,184 | 2/1989 | Shannon | 156/71 |
| 4,811,918 | 3/1989 | Grooms . | |
| 4,828,432 | 5/1989 | Ives | 405/270 |
| 4,867,816 | 9/1989 | Suiter | 156/71 |
| 4,869,044 | 9/1989 | Wald | 52/746 |
| 5,042,221 | 8/1991 | Pacione | 52/749 |
| 5,134,831 | 8/1992 | Avellanet . | |
| 5,277,351 | 1/1994 | McCullagh . | |
| 5,409,177 | 4/1995 | Parry et al. . | |

OTHER PUBLICATIONS

Promotional brochure entitled "The Housewrap That Survives," relating to Typar® housewrap.

Promotional brochure entitled "How To Wrap a Home In Energy Savings," relating to Tyvek® housewrap.

*Primary Examiner*—Carl D. Friedman
*Assistant Examiner*—Yvonne M. Horton
*Attorney, Agent, or Firm*—Wallenstein & Wagner Ltd.

[57] ABSTRACT

An apparatus and method for dispensing and applying flexible sheet material, such as house wrap, from an elongate roll in a substantially continuous manner to the planar surface of a structure.

6 Claims, 3 Drawing Sheets

APPARATUS AND METHOD FOR APPLICATION OF FLEXIBLE SHEET STOCK

This is divisional of copending application Ser. No. 08/283,852, now U.S. Pat. No. 5,667,165, filed on Aug. 1, 1994.

TECHNICAL FIELD

This invention relates to an apparatus and method for dispensing flexible sheet material, such as that commonly referred to as "housewrap," to be applied to a planar surface of a structure, such as a house or other building.

BACKGROUND OF THE INVENTION

In numerous applications, it is desirable to apply flexible sheet stock to a structure. The flexible sheet stock is typically provided in elongated rolls, usually wrapped onto a hollow core. One such use of flexible sheet stock is the application of the sheet material to a structure, such as a house or building. The sheet stock used for such applications is typically referred to as "housewrap."

It has become common practice in building new structures, and in re-siding old structures, to cover the exterior of the structure with housewrap. When applied, the housewrap is beneficial as an infiltration barrier, reducing air flow and preventing moisture infiltration into the structure. Examples of such housewrap products are sold under the trademarks TYVEK®, sold by E.I. duPont de Nemours & Company, and TYPAR®, sold by Reemay. Such housewrap is sold in rolls of differing lengths, and the housewrap is often available in different widths. For example, TYVEK® housewrap is available in three (3), five (5), nine (9) and ten (10) foot widths, and at lengths varying between 100 to 200 feet long. Also, U.S. Pat. No. 5,134,831, issued to Avellanet on Aug. 4, 1992, discloses a similar housewrap material, comprised of a flexible substrate sheet having at least one metal layer to enhance energy efficiency.

The common practice for applying housewrap is for two or more persons to simply unroll the housewrap while attaching it to the structure with nails or staples. This method is briefly discussed in U.S. Pat. No. 5,134,831 (Avellanet). The housewrap is unrolled by unwinding the housewrap from the elongated roll, with the intended inner surface of the housewrap held against the surface of the structure. The housewrap is then held in place upon the structure, while it is attached to the structure. This method usually requires at least two persons, one person to hold and unroll the housewrap, and one person to secure the housewrap to the structure surface. Also, because of the slippery nature of the housewrap material, the difficulty of managing the housewrap in windy conditions, and the difficulty of applying housewrap at the areas above ground level, this method may require several persons and, in some circumstances, would be dangerous or impossible. Further, because the housewrap is typically several feet in width, it is difficult for the persons installing the housewrap to prevent occasional slack or looseness, and the housewrap, once applied, is therefore loose and contains large pockets of air.

Another method for applying the housewrap to a structure is to use a "tilt wall" method; that is, to apply the housewrap to a wall section which is constructed prior to tilting the wall to its intended vertical orientation. Using this method, the housewrap is unrolled onto the wall section and fastened to the wall section, such as with nails or wire staples, prior to the wall being raised and positioned in its intended vertical orientation. The housewrap is unrolled by unwinding the housewrap from the elongated roll, with the intended inner surface of the housewrap held against the surface of the wall portion of the structure. Once the housewrap is fastened, the wall section is raised or "tilted," and then secured at its intended place and vertical orientation. However, the "tilt wall" method requires several persons, and is often not the preferred method of constructing a structure. Because the housewrap is applied to the wall sections, each section must overlap and must be carefully applied to prevent undesired exposed seams. Further, because the housewrap is typically several feet in width, it is difficult for the persons installing the housewrap to prevent occasional slack or looseness, and the housewrap, once applied, is therefore loose and contains large pockets of air. Also, this method of applying housewrap and then raising the wall section is difficult because of the slippery nature of the housewrap, and the potential for unfastening the housewrap when "tilting" the wall to its vertical position, problems which are only amplified when the housewrap is applied loosely.

SUMMARY OF THE INVENTION

One object of the present invention provides an apparatus and method for dispensing sheet stock material in a substantially continuous manner and applying the sheet stock to the planar surface of a structure. Another object of the present invention is to provide an apparatus and method for dispensing and applying housewrap sheet stock to the planar surface of a structure.

The apparatus of the present invention is a device for dispensing flexible sheet material from an elongated roll which is applied to the planer surface of a structure. The device includes a handle and a pair of hub assemblies attached to the handle. The hub assemblies are spaced apart at a length approximately equal to the length of the elongated roll of flexible sheet material.

The method of the present invention is the method of applying sheet stock to a planar surface of a structure which includes retaining the roll of sheet stock in a dispenser and aligning the roll of sheet stock substantially parallel to the planar surface. The end of the sheet stock is initially fastened to the planar surface of the structure, and the sheet stock is dispensed from the roll in a substantially continuous fashion by pulling the dispenser along the planar surface of the structure. While maintaining the sheet stock taut and in substantially parallel orientation with the planar surface, the sheet stock is fastened to the planar surface as it is dispensed.

Other advantages and aspects of the present invention will become apparent upon reading the following description of the drawings and detailed description of the invention.

DETAILED DESCRIPTION

Figure 1:
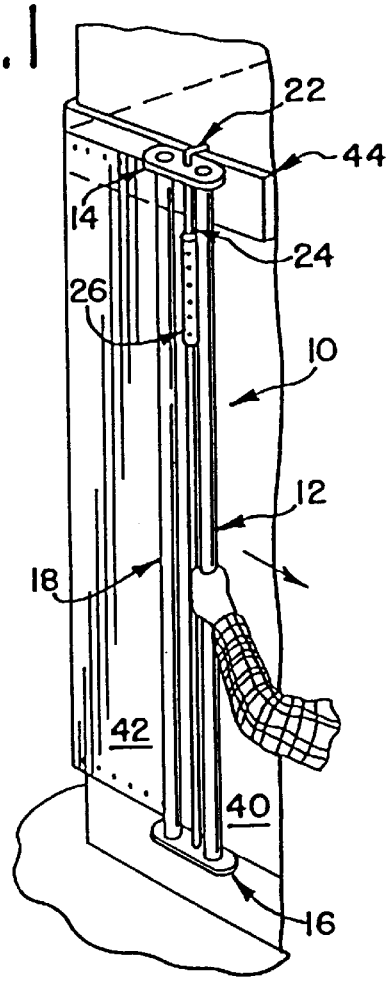
FIG. 1 is a perspective view of one embodiment of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

Figure 5:
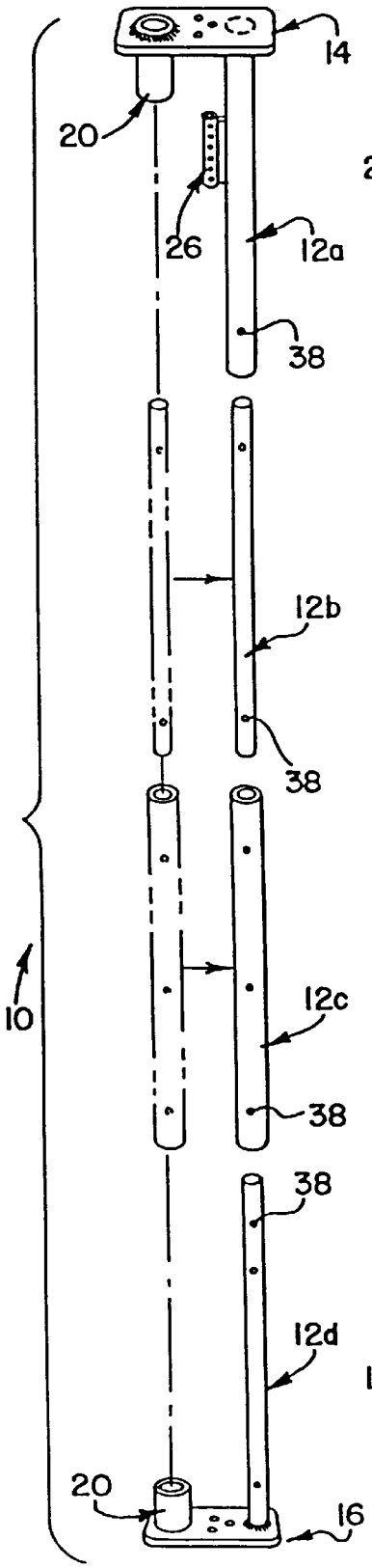
FIG. 5 is a side view of one embodiment of the present invention with segments of the device separated.

Referring to the drawings, FIG. 1 discloses a preferred embodiment of a device and method for dispensing and applying flexible sheet stock from an elongated roll to the planar surface of a structure. The dispensing device 10 has a handle 12 attached to a top hub assembly 14 and a bottom hub assembly 16. An elongated roll of flexible sheet stock 18 is received between the top hub assembly 14 and the bottom hub assembly 16. As can be best seen in FIGS. 5 and 6, the top and bottom hub assemblies, 14 and 16, include a hub 20, which is inserted within the core of the elongated roll 18.

The device of FIG. 1 also preferably includes a guide 22. As can be best seen in FIGS. 2–4, the guide preferably includes a guide hook 36 which extends above the top hub assembly 14. The guide 22 preferably includes a guide shaft 24, and guide shaft extensions 32 and 34 which may be secured to the guide shaft 22 and thereby extending its length.

Preferably, the distance which the guide 22 extends beyond the top hub assembly 14 is adjustable. In the preferred embodiment, the guide 22 consists of a guide shaft 24 which includes a series of holes 30, approximately six (6) inches apart. Also, in the preferred embodiment, the guide shaft 24 passes through an opening in the top hub assembly 14 and passes through a guide shaft brace 26 which is secured to the handle 12. The guide shaft brace 26 preferably has an inner diameter slightly greater than the outer diameter of the guide shaft 24, and includes a series of holes 28 which may align with a corresponding guide shaft hole 30, and a locking pin (not shown) may then be inserted through the holes to secure the guide in place. Accordingly, the distance which the hook 36 of the guide 22 extends beyond the top hub assembly 14 is adjustable by aligning different holes of the guide shaft 24 with those of the guide shaft brace 26.

Figure 2:
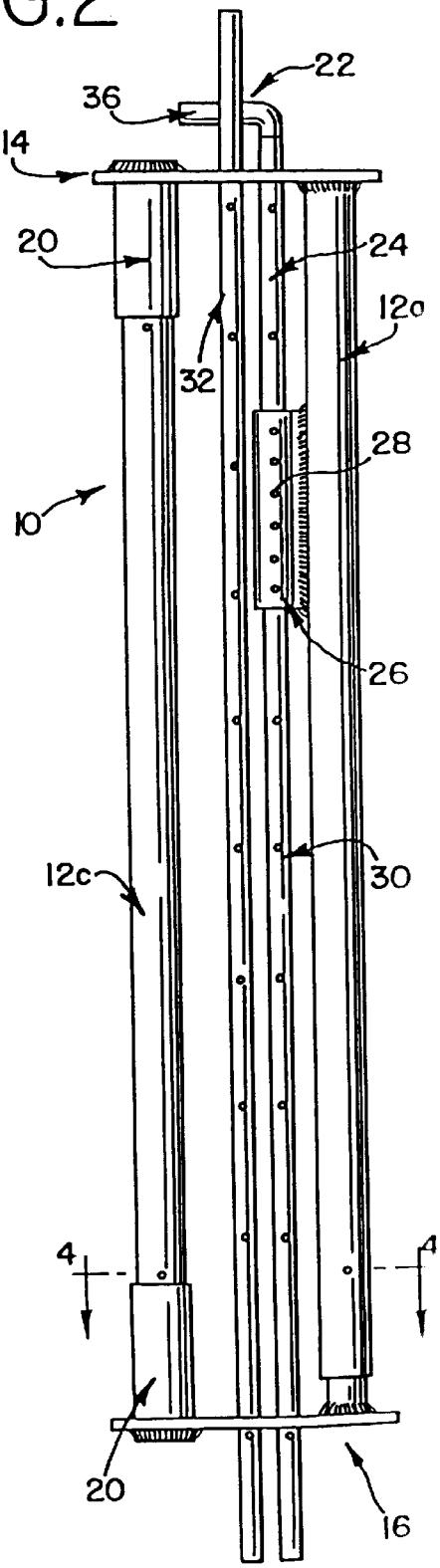
FIG. 2 is a side view of one embodiment of the present invention as it is collapsed for storage or carrying.
Figure 3:
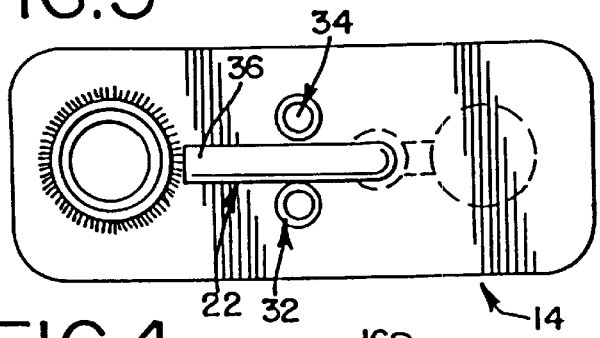
FIG. 3 is a view of the top of the device of FIG. 2.
Figure 4:
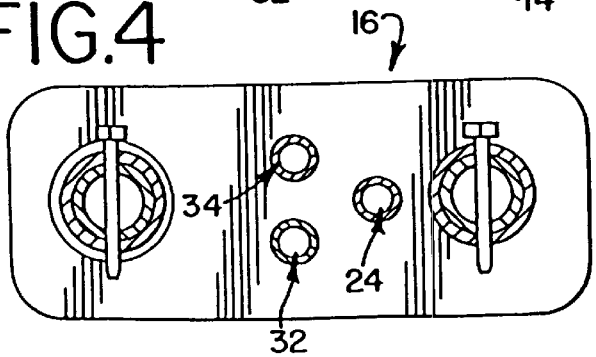
FIG. 4 is a cross-sectional view taken along 4—4 of FIG. 2.

As can be best seen in FIGS. 2 and 3, when the device 10 is collapsed for storage or carrying, the guide shaft 24, and guide shaft extensions, 32 and 34, pass through openings in the top hub assembly 14 and the bottom hub assembly 16. The guide shaft 24 is preferably secured in place by inserting a pin (not shown) through a guide shaft hole 30 as it is properly aligned with the guide shaft brace 26. The guide shaft extensions, 32 and 34, are preferably secured in place by inserting pins (not shown) through a hole in the guide shaft extensions, 32 and 34.

As is best shown in FIGS. 5–9, the device 10 is suitable for dispensing differing lengths of flexible sheet stock rolls 18. Preferably, this is achieved by adjusting the distance between the top hub assembly 14 and the bottom hub assembly 16, by adjustment of the length of handle 12. In the preferred embodiment, the handle 12 is comprised of four (4) handle sections, 12*a*, 12*b*, 12*c*, and 12*d*, each approximately three (3) feet in length. Each section of the handle 12 preferably includes holes 38 (FIG. 5) through the thickness of the handle 12 for securing together sections of the handle 12 to a desired length. The top handle section 12*a* is attached to the top hub assembly 14, and the bottom handle section 12*d* is attached to the bottom hub assembly 16.

Figure 9:
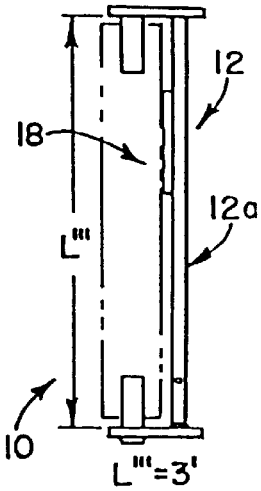
FIG. 9 is a side view of one embodiment of the present invention which contains a 3 foot long roll of sheet stock material.
Figure 8:
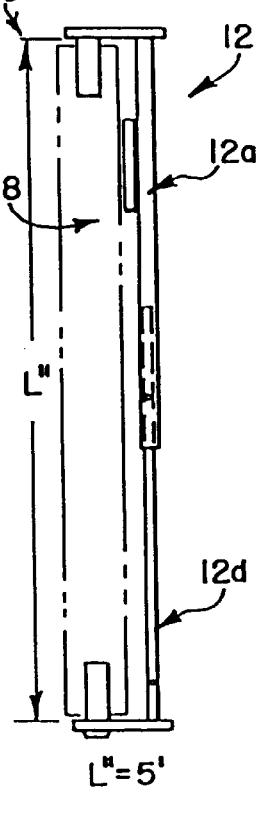
FIG. 8 is a side view of one embodiment of the present invention which contains a 5 foot long roll of sheet stock material.

As is best shown in FIGS. 8 and 9, the device 10 is suitable for receiving a sheet stock roll 18 which is of relatively small width, such as three (3) foot or five (5) foot. The bottom handle section 12*d* has an outer diameter slightly smaller than the inner diameter of the top handle section 12*a*, and the bottom handle section 12*d* may be inserted into the top handle section 12*a*. The handle sections, 12*a* and 12*d*, are secured together at the desired length of the handle 12, preferably by aligning the holes 38 of each, and inserting a pin (not shown).

Figure 6:
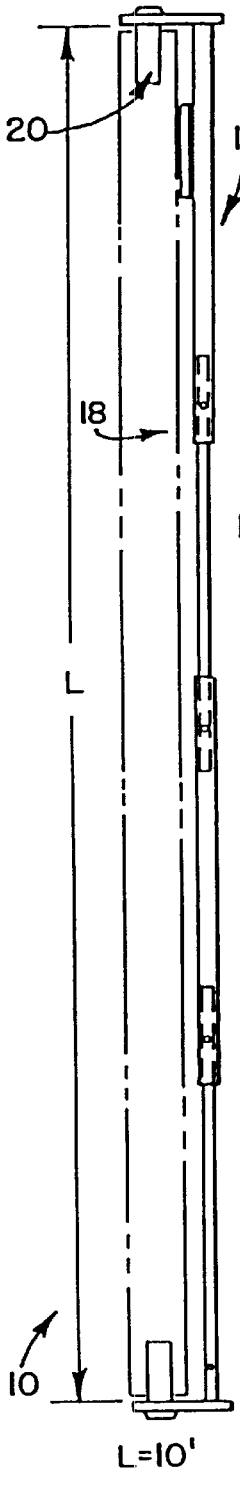
FIG. 6 is a side view of one embodiment of the present invention which contains a 10 foot long roll of sheet stock material.
Figure 7:
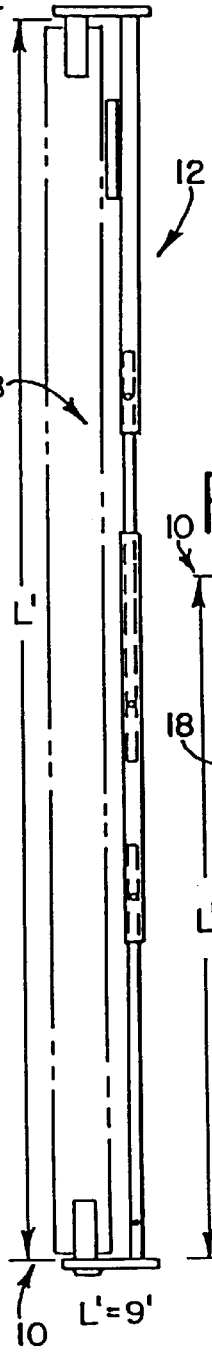
FIG. 7 is a side view of one embodiment of the present invention which contains a 9 foot long roll of sheet stock material.

As is best shown in FIGS. 6 and 7, the device 10 is suitable for receiving a sheet stock roll 18 which is of relatively larger width, such as nine (9) foot or ten (10) foot. The second handle section 12*b* has an outer diameter slightly smaller than the inner diameter of the top handle section 12*a* and the third handle section 12*c*, and the second handle section 12*b* is partially inserted into the top handle section 12*a* and the third handle section 12*c*. The bottom handle section 12*d* has an outer diameter slightly smaller than the inner diameter of the third handle section 12*c*, and is partially inserted into the third handle section 12*c*. The handle sections, 12*a*, 12*b*, 12*c* and 12*d*, are secured together at the desired length of the handle 12, preferably by aligning the holes 38 of each, and inserting a pin (not shown).

As is best shown in FIG. 2, the sections of the handle 12 device 10 may be collapsed together to its minimal height for storage or carrying. Preferably, the second handle section 12*b* is entirely inserted within the third handle section 12*c*, and the third handle section 12*c* is then received between the top hub assembly 14 and the bottom hub assembly 16. Also, the bottom handle section 12*d* is entirely inserted within the top handle section 12*a*, so that the guide shaft 24 and guide shaft extensions 32 and 34 pass through openings in the top hub assembly 14 and the bottom hub assembly 16.

Figure 11:
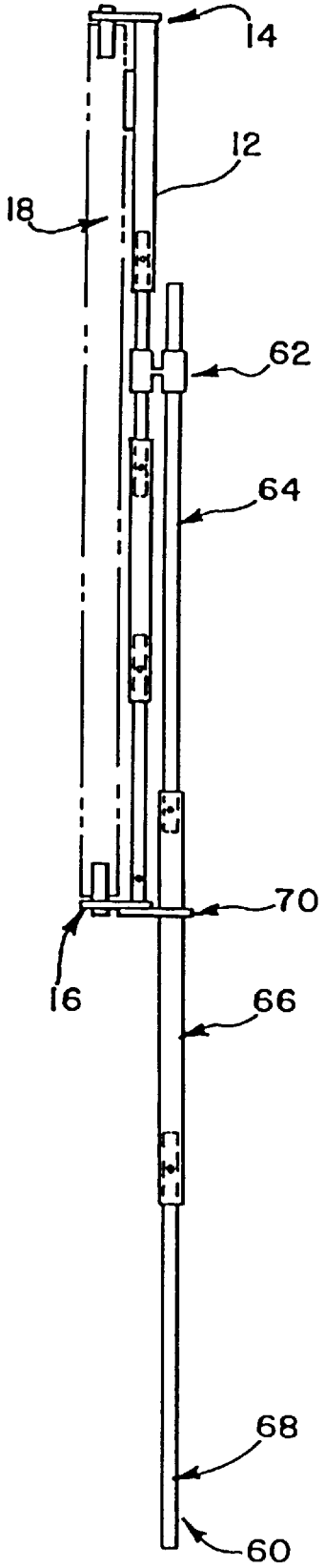
FIG. 11 is a side view of one embodiment of the present invention with an extension of the handle.

As is best shown in FIG. 11, the device 10 may also include a handle extension 60 for gaining leverage or for extending the handle for dispensing the flexible sheet stock roll 18 at a greater height or in the presence of unsuitable terrain. Preferably, the handle extension 60 is formed of handle extension sections, 64, 66, and 68, which, when assembled, are received into one another much like the handle 12 discussed above. In one embodiment of the invention, the top extension section 64 attaches to the handle 12, preferably by an extension bracket 62 which may be received over the handle 12 and the handle extension 60, and may be secured in place. The handle extension 60 also preferably includes a base 70 which attaches to the bottom hub assembly 16 and may be secured in place.

As is best shown in FIG. 1, the method for dispensing the flexible sheet stock roll 18 is comprised of securing the roll within the dispensing device 10, and aligning the roll 18 substantially parallel with the planar surface of the structure 40. The loose end of the sheet stock 42 is fastened to the planar surface of the structure 40, and the sheet stock is dispensed from the roll 18 in a substantially continuous fashion by pulling the dispenser along the planar surface of the structure 40. While maintaining the sheet stock taut and in substantially parallel orientation with the planar surface of the structure 40, the sheet stock is fastened to the planar surface 40 as the roll 18 is dispensed. The sheet stock may be applied to cover any openings (not shown) in the surface of the structure 40, such as windows or doors. When the surface of the structure 40 is covered, then person installing the sheet stock may return to X-out window and door openings with a knife, pulling the sheet stock in over the frames of the openings.

In accordance with one embodiment of the present invention, a guide 22 is utilized to maintain the device 10 substantially parallel to the planar surface of the structure 40, as the roll 18 is dispensed and the sheet stock is attached. The method of utilizing the guide 22 is comprised of engaging the guide 22 with a channel surface 44. Preferably, the method includes adjusting the length in which the guide 22 extends above the top hub assembly 14 of the device 10, primarily by adjusting the length of the guide shaft 24.

The channel surface may be comprised of a channel or lathing which is temporarily attached to the planar surface of the structure 40, or it may be comprised of a horizontal surface or extension of the planar surface, such as the upper plate of the structure. If the structure is a house or similar building with more than a first-floor level, then the method of applying the sheet stock preferably includes engaging the guide 22 with the upper plate of the lower level of the structure, prior to constructing the upper level of the structure.

Figure 10:
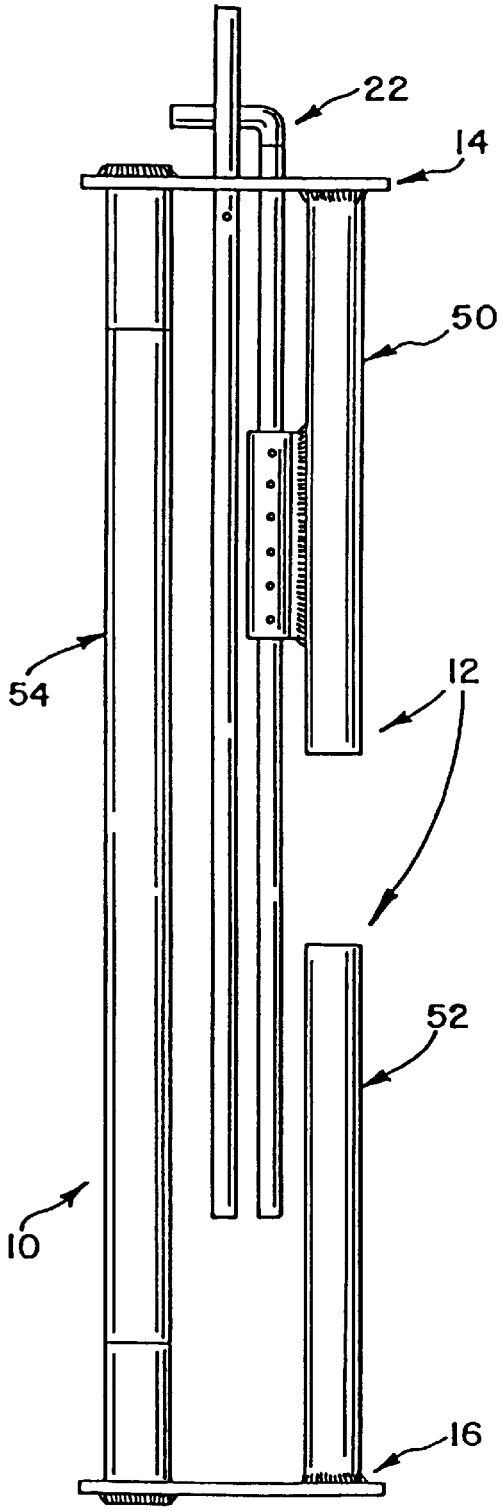
FIG. 10 is an alternative embodiment of the present invention.

FIG. 10 shows an alternative embodiment of the present invention in which the handle 12 of the dispensing device 10 is not continuous between the top hub assembly 14 and the bottom hub assembly 16. In this embodiment, the handle is comprised of a first handle 50 attached to the top hub assembly 14, and a second handle 52 attached to the bottom hub assembly 16. Preferably, the first handle 50 and second handle 52 extend generally toward each other, and a continuous shaft 54, or axle, is attached to both the top hub assembly 14 and the bottom hub assembly, and is suitable for being received within the core of the roll of flexible sheet material.

While the specific embodiments have been illustrated and described, numerous modifications come to mind without significantly departing from the spirit of the invention and the scope of protection is only limited by the scope of the accompanying Claims.

I claim:

1. A method of applying sheet stock to a planar surface of a structure, comprising the steps of:

retaining said roll of sheet stock in a dispenser having a first and second hub assembly joined by a handle, wherein the handle length between said hub assemblies is adjustable;

aligning said roll of sheet stock substantially parallel to said planar surface;

fastening the end of said sheet stock to said structure;

dispensing said sheet stock from said roll in a substantially continuous fashion by pulling said dispenser along the planar surface;

maintaining said sheet stock which is dispensed to substantially parallel orientation with said planar surface;

attaching a guide to said dispenser;

guiding said roll of sheet stock by engaging said guide against a horizontal surface integral with said planar surface of said structure; and, fastening said sheet stock to said planar surface as it is dispensed.

2. The method of claim 1, wherein the step of retaining said roll of sheet stock in a dispenser includes the step of adjusting the handle length between said hub assemblies by moving at least on of said hub assemblies along the handle.

3. The method of claim 1, comprising the steps of:

attaching a guide channel as said horizontal surface integral with said planar surface.

4. A method of applying housewrap from an elongated roll of housewrap to a planar surface of a structure, comprising the steps of:

retaining said roll of housewrap in a dispenser having a first and second hub assembly joined by a handle having a length between said hub assemblies, wherein said handle length is adjustable;

aligning said roll of housewrap substantially parallel to said planar surface;

fastening the end of said roll of housewrap to said structure with fasteners;

dispensing said housewrap from said roll in a substantially continuous fashion by pulling said dispenser along said planar surface;

maintaining said housewrap which is dispensed to substantially parallel orientation with said planar surface; and, fastening said housewrap to said planar surface with fasteners as it is dispensed.

5. The method of claim 4, wherein the step of retaining said roll of housewrap in a dispenser includes the step of adjusting the handle length joining the hub assemblies.

6. The method of claim 4, wherein before the step of dispensing said housewrap, the step of adjusting the handle to extend beyond the first hub assembly away from the second hub assembly.

* * * * *